US006000478A

United States Patent [19]

Hsiao

[11] Patent Number: 6,000,478

[45] Date of Patent: Dec. 14, 1999

[54] VIBRATING DEVICE FOR A SCULPTURING TOOL

[75] Inventor: Shu-Wen Hsiao, Taichung Hsien, Taiwan

[73] Assignee: We Cheer Industrial Co., Ltd., Taichung Hsien, Taiwan

[21] Appl. No.: 09/167,977

[22] Filed: Oct. 8, 1998

[51] Int. Cl.[6] ..... B25D 11/10

[52] U.S. Cl. ..... 173/205; 173/124; 173/217

[58] Field of Search ..... 173/122, 125, 173/124, 205, 128, 178, 114, 117, 217; 30/169, 272.1

[56] References Cited

U.S. PATENT DOCUMENTS 2,974,533 3/1961 Demo ..... 173/205
3,163,237 12/1964 Fulop ..... 173/205
5,287,582 2/1994 Kawai et al. ..... 173/205
5,669,453 9/1997 Akazawa ..... 173/124
5,803,183 9/1998 Phillips ..... 173/205

*Primary Examiner*—Scott A. Smith
*Attorney, Agent, or Firm*—Rosenberg, Klein & Lee

[57] ABSTRACT

A sculpturing tool includes a movable member and a rotatable member respectively received in the main tube which is connected to a driving member connected to the rotatable member. The movable member is connected to blade at its first end and has a first ball rotatably and eccentrically received in its second end thereof. The rotatable member has a second ball rotatably and eccentrically received in the end opposite to the driving member so that when the rotatable member is rotated, the movable member is moved in the longitudinal direction when the second ball rolls over the first ball.

4 Claims, 5 Drawing Sheets

VIBRATING DEVICE FOR A SCULPTURING TOOL

FIELD OF THE INVENTION

The present invention relates to a sculpturing tool, and more particularly, to the vibrating device for a sculpturing tool and the vibrating device comprising a rotatable member and a movable member, each of which has a ball rotatably received in the two respective contacting surfaces so as to reduce contact area therebetween and the heat generated therefor.

BACKGROUND OF THE INVENTION

A conventional sculpturing tool has a chuck device connected to the front end of the tool so as to securely connect a blade or the like thereto. The chuck device is driven by a vibrating device which is operated at a very high speed to that the blade can remove material of the object to be formed a desired article. The vibrating device generally comprises two parts which move relative to each other so that a high temperature heat will be generated between the two contact surfaces of the two parts. The heat will transferred to the user's hand holding the sculpturing tool, this makes the user uncomfortable, although there is a sleeve mounted to the device.

The present invention intends to provide the vibrating device of the sculpturing tool, wherein the vibrating device comprises two parts each of which has a ball eccentrically and rotatably mounted thereto so that the contact area is very small when one of the two parts is rotated to push the other part to move in the longitudinal direction. Therefore, the vibrating device of the present invention can well resolve the problems as mentioned above.

SUMMARY OF THE INVENTION

In accordance with one aspect of the present invention, there is provided a sculpturing tool comprising a main tube having a flange extending radially inward from the inner periphery of the first end thereof, a sleeve inserted into the main tube and contacting the underside of the flange, the sleeve having two slots defined through the peripheral wall thereof.

A movable member is inserted through the sleeve and its first end extends from the first end of the main tube and the second end of the movable member has a first hole defined eccentrically in the bottom thereof. A first ball is rotatably received in the first hole. Two stubs extend radially outward from the movable member and are respectively and movably received in the two slots of the sleeve.

A rotatable member has a second hole defined eccentrically in the first end thereof which faces to the second end of the movable member. A second ball is rotatably received in the second hole. An end member is connected to the second end of the main tube and a driving member extends through the end member and is connected to the rotatable member so that when the rotatable member is rotated by the driving member, the movable member is moved when the second ball rolls over the first ball.

The object of the present invention is to provide a vibrating device for a sculpturing tool wherein the contact area is very small between the rotatable member and the movable member.

Further objects, advantages, and features of the present invention will become apparent from the following detailed description with appropriate reference to the accompanying drawings.

BRIEF DESCRIPTION OF THE DRAWINGS

FIG. 1 is a perspective view of the sculpturing tool in accordance with the present invention;

DETAILED DESCRIPTION OF THE PREFERRED EMBODIMENT

Figure 1:
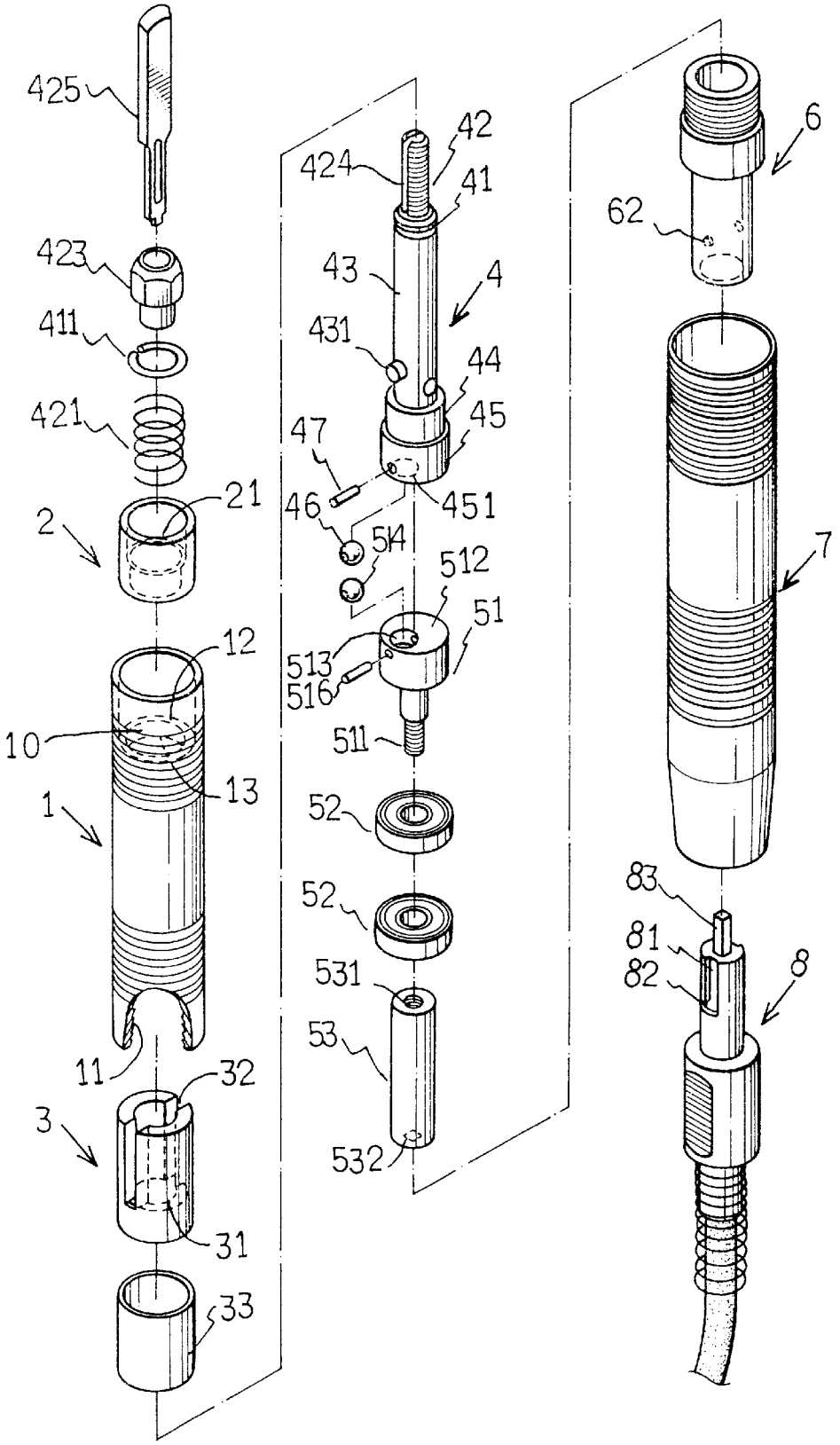
FIG. 1 is an exploded view of the sculpturing tool in accordance with the present invention.
Figure 2:
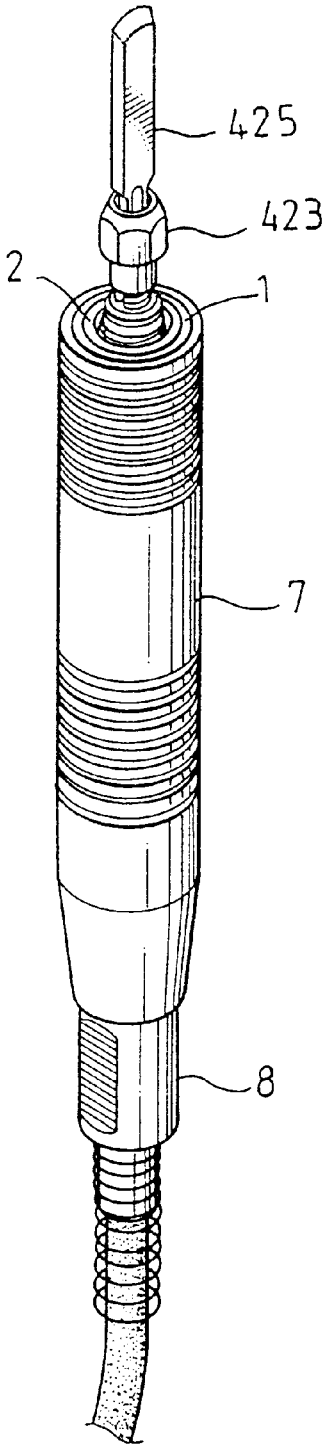
Figure 3:
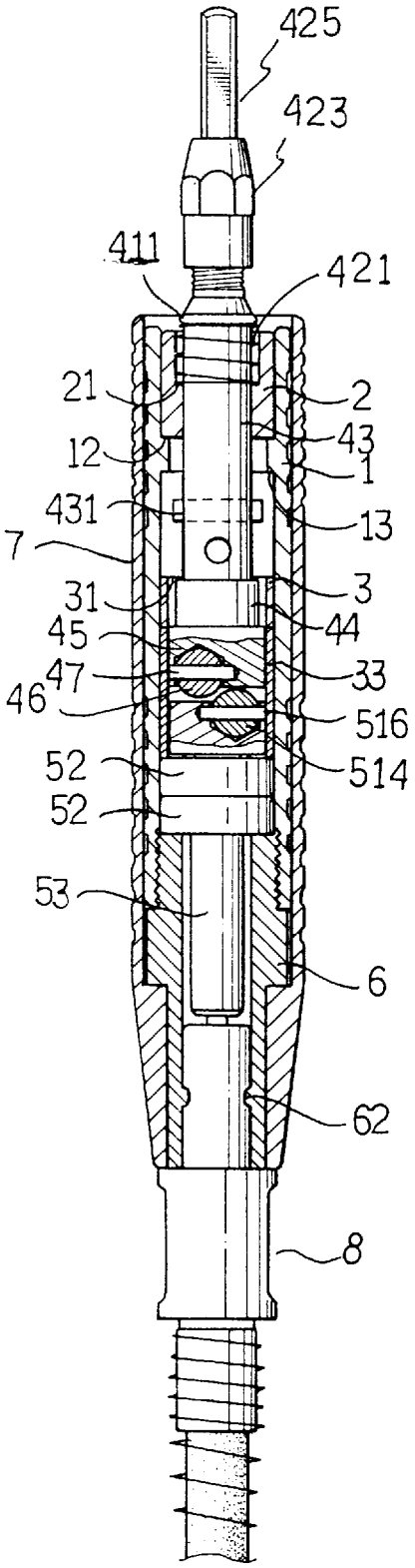
FIG. 3 is a side elevational view, partly in section, of the sculpturing tool in accordance with the present invention.

Referring to FIGS. 1 to 3, the sculpturing tool in accordance with the present invention comprises a main tube 1 having a flange 10 extending radially inward from the inner periphery of the first end thereof and an inner threaded periphery 11 defined in the second end thereof. A seat member 2 received in the first end of the main tube 1 and supported by the upper side 12 of the flange 10. A sleeve 3 is inserted into the main tube 1 from the second end of the main tube 1 and contacts the underside 13 of the flange 10, the sleeve 3 having two slots 32 defined through the peripheral wall thereof. An annular shoulder portion 31 defined in the inner periphery of the sleeve 3.

A movable member 4 is inserted through the sleeve 3 and the main tube 1, the movable member 4 having the first end 42 thereof extending from the first end of the main tube 1 and the second end 45 of the movable member 4 having a first hole 451 defined eccentrically in the bottom thereof. The first end 42 of the movable member 4 has a slit 424 defined longitudinally so as to receive the blade 425 in the slit 424. A ring 411 is received in the groove 41 defined in the movable member 4 and located below the first end 42 of the movable member 4 so that a spring 421 is mounted to the first end 42 of the movable member 4, wherein the spring 421 is biased between the ring member 411 and a shoulder portion 21 defined in the seat member 2 so that the spring 421 pushes the movable member 4 down when the movable member 4 is operated up and down. A nut member 423 is threadedly mounted to the first end 42 of the movable member 4 to firmly clamp the blade 425 by the two portions of the first end 42 separated by the slit 424. A section 44 extends radially outward from the shank 43 of the movably member 4 so as to engage with the annular shoulder portion 31 of the sleeve 3.

A first ball 46 is received in the first hole 451 and rotatable about a pin 47 extending through the second end 45 of the movable member 4. Two stubs 431 extend radially outward from the shank 43 of the movable member 4 and are respectively and movably received in the two slots 32 of the sleeve 3.

A rotatable member 51 has a second hole 513 defined eccentrically in the first end 512 thereof which faces to the second end 45 of the movable member 4. A second ball 514 is received in the second hole 513 and rotatable about a pin 516 extending through the first end 512 of the rotatable member 51. A threaded rod 511 extends from the second end of the rotatable member 51 and is threadedly engaged with a threaded hole 531 of the tube 53 to which two bearings 52 are mounted. The tube 53 has a polygonal recess 532 defined in the end opposite to the threaded hole 531. A bushing 33 is received in the main tube 1 and the second end 45 of the movable member 4 and the first end 512 of the rotatable member 51 are received therein.

An end member 6 is threadedly engaged with the inner threaded inner periphery 11 of the second end of the main tube 1. A driving member 8 extends through the end member 6 and has a polygonal shaft 83 which is received in the polygonal recess 532 of the tube 53.

Figure 4:
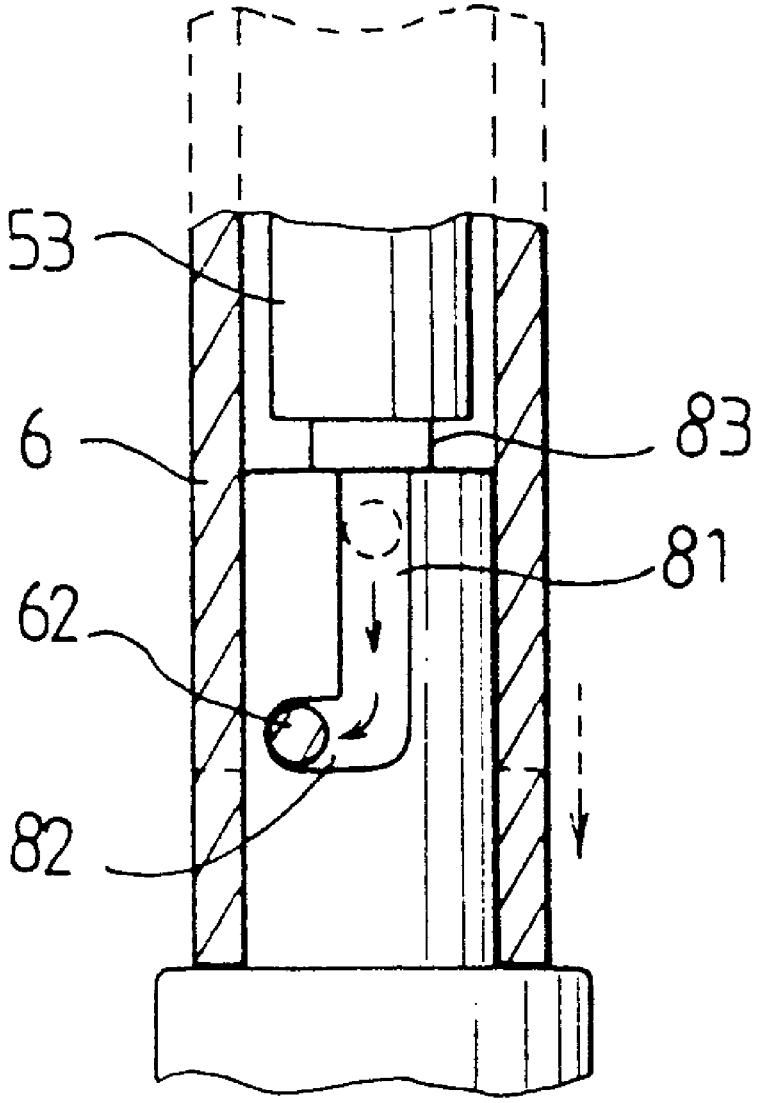
FIG. 4 is an illustrative view to illustrate the bosses of the end member is received in the L-shaped groove of the driving member of the sculpturing tool of the present invention.

The end member 6 has two basses 62 extending radially inward from the inner periphery thereof and the driving member 8 has two L-shaped grooves defined in the outer periphery thereof. Further referring to FIG. 4, each of the L-shaped groove has a vertical portion 81 and a horizontal portion 82 so that when the driving member 8 extends into the end member 6, the two basses 62 are received along the two respective vertical portion 81 and then rotating the driving member 8 to let the two bosses 62 be received in the two horizontal portions 82 of the L-shaped grooves. Therefore, the driving member 8 is connected to the end member 6. A heat-isolating sleeve 7 is mounted to the main tube 1 for the user's hand grasping the sculpturing tool.

Figure 5:
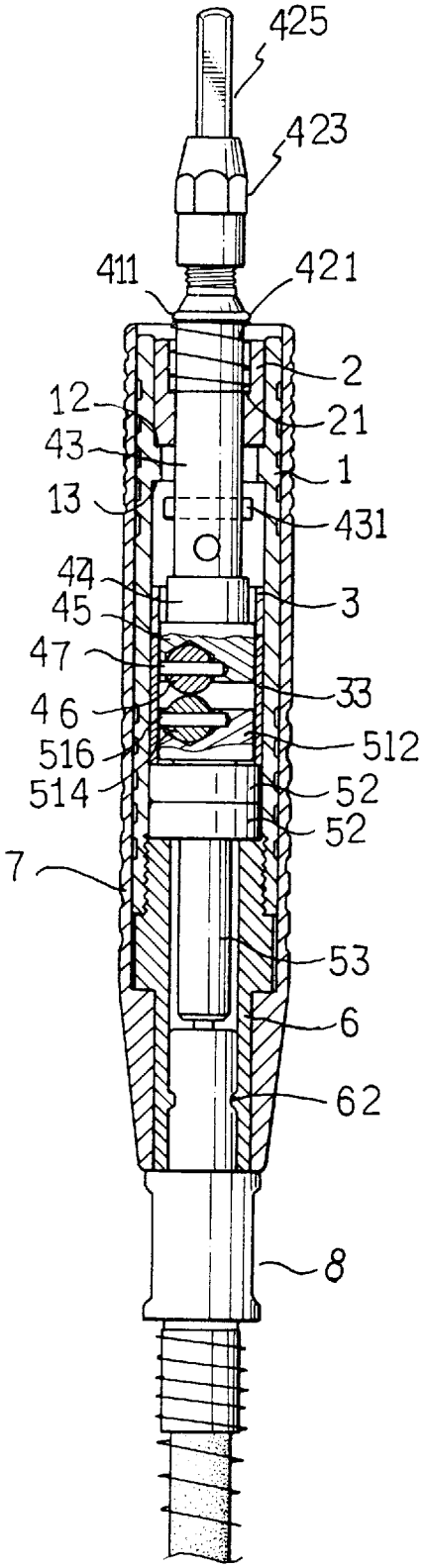
FIG. 5 is a side elevational view, partly in section, of the sculpturing tool when the movable member is moved.

Referring to FIG. 5, when the shaft 83 of the driving member 8 is rotated, the tube 53 together with the rotatable member 51 are rotated, when the second ball 514 rolls over the first ball 46, the movable member 4 is moved toward the blade 425 and when the second ball 514 is moved away from the first ball 46, the movable member 4 is moved downwardly.

Therefore, the heat generated by the contact between the two balls 46, 514 is very few and the heat may escapes from the two slots 32 of the sleeve 3 so that the user can hold the sculpturing tool without feeling high temperature generated from the sculpturing tool of the present invention.

The invention is not limited to the above embodiment but various modification thereof may be made. It will be understood by those skilled in the art that various changes in form and detail may made without departing from the scope and spirit of the present invention.

What is claimed is:

1. A sculpturing tool comprising:

a main tube having a flange extending radially inward from the inner periphery of the first end thereof;

a sleeve inserted into said main tube and contacting the underside of said flange, said sleeve having two slots defined through the peripheral wall thereof;

a movable member inserted through said sleeve and said main tube, said movable member having the first end thereof extending from the first end of said main tube and the second end of said movable member having a first hole defined eccentrically in the bottom thereof, a first ball rotatably received in said first hole, two stubs extending radially outward from said movable member and respectively and movably received in said two slots of said sleeve;

a rotatable member having a second hole defined eccentrically in the first end thereof which faces to said second end of said movable member, a second ball rotatably received in said second hole, and an end member connected to the second end of said main tube and a driving member extending through said end member and connected to said rotatable member so that when said rotatable member is rotated by said driving member, said movable member is moved when said second ball rolls over said first ball.

2. The vibrating device as claimed in claim 1 further comprising two basses extending radially inward from the inner periphery of said end member and said driving member having two L-shaped grooves defined in the outer periphery thereof so that said two basses are received in said two L-shaped grooves and said driving member is connected to said end member.

3. The vibrating device as claimed in claim 1 further comprising a tube connected to the second end of said rotatable member and said tube having a polygonal recess defined in one of two ends thereof, said driving member having a shaft extending therefrom so as to be engaged with said polygonal recess.

4. The vibrating device as claimed in claim 1 further comprising a bushing in which the second end of said movable member and the first end of said rotatable member are received.

* * * * *